US006884119B2

(12) United States Patent
Brooks et al.

(10) Patent No.: US 6,884,119 B2
(45) Date of Patent: Apr. 26, 2005

(54) TERMINAL BLOCK WITH SHOULDER CONTACT AND FORMED GROUND PLATE RETAINED BY PLASTIC INSERT

(75) Inventors: John Leslie Brooks, Trenton (CA); John Peter van den Enden, Oshawa (CA); Valeria Caraiani, Thornhill (CA); Barbara Heather Marten, Toronto (CA); Peter Ervin Jay, Scarborough (CA); Ming Jong, North York (CA); Karen Anne Gibson, Uxbridge (CA)

(73) Assignee: Amphenol Corporation, Wallingford, CT (US)

( * ) Notice: Subject to any disclaimer, the term of this patent is extended or adjusted under 35 U.S.C. 154(b) by 0 days.

(21) Appl. No.: 09/971,185

(22) Filed: Oct. 5, 2001

(65) Prior Publication Data

US 2002/0042231 A1 Apr. 11, 2002

Related U.S. Application Data

(60) Provisional application No. 60/238,027, filed on Oct. 6, 2000.

(51) Int. Cl.[7] ..... H01R 13/66; H01R 33/945; H01R 4/66; H01R 13/648

(52) U.S. Cl. ..... 439/620; 439/92

(58) Field of Search ..... 439/620, 69, 92, 439/939, 709, 825, 82, 597, 839, 592

(56) References Cited

U.S. PATENT DOCUMENTS

| | | | | | |
|---|---|---|---|---|---|
| 4,500,159 | A | | 2/1985 | Briones et al. | 339/147 |
| 4,630,983 | A | * | 12/1986 | Fischer | 411/15 |
| 4,950,185 | A | | 8/1990 | Boutros | 439/620 |
| 5,057,041 | A | * | 10/1991 | Yu et al. | 439/620 |
| 5,102,354 | A | * | 4/1992 | Crane et al. | 439/620 |
| 5,221,216 | A | * | 6/1993 | Gabany et al. | 439/620 |
| 5,242,318 | A | | 9/1993 | Plass | 439/620 |
| 5,340,334 | A | | 8/1994 | Nguyen | 439/620 |
| 5,397,250 | A | | 3/1995 | Briones | 439/620 |
| 5,580,280 | A | * | 12/1996 | Minich et al. | 439/620 |
| 5,895,293 | A | | 4/1999 | Brandberg et al. | 439/620 |
| 6,036,545 | A | | 3/2000 | Caviness et al. | 439/620 |
| 6,080,020 | A | | 6/2000 | Grabbe | 439/620 |
| 6,386,888 | B1 | * | 5/2002 | Skopic et al. | 439/63 |

* cited by examiner

*Primary Examiner*—Chandrika Prasad
(74) *Attorney, Agent, or Firm*—Blank Rome LLP

(57) ABSTRACT

A connector has a plastic housing (10) with a plurality of cavities or holes (13) for accepting "chips" (3), i.e., electrical elements such as transient suppression diodes, capacitors, metal oxide varisters, spark gap devices, and so on, connected between the a contact (20) and ground for RFI or EMI suppression or the like. The contacts have shoulders with chip-contacting areas (23), preferably one surface of an annular flange (21). This allows numerous cavities to be arrayed around the axis of the contact (which can be radially symmetrical) so that numerous chips can be put in parallel between the contact and ground. In the case of capacitor chips, for example, this allows increasing the capacitance or varying the capacitance from one contact to the next. Grounding the ends of the chips opposite the contact shoulder is through a conductive spring, which can be a tine (43) bent from the inner periphery of an opening in a sheet-metal ground plate (40), or else can be a distinct item such as a piece of conductive elastomer (70). The ground plate is preferably fitted into the bottom of the housing along with a plastic retention insert which acts as a platform to supporting the tines and resist the force of the springs against the chips. The ground plate can be embodied as one or two ground strips running along either side of the connector. A contact has compliant tines that are augmented with an internal coiled spring. The contacts can be used (but are not limited in application) in a connector press fit into a PCB.

27 Claims, 8 Drawing Sheets

TERMINAL BLOCK WITH SHOULDER CONTACT AND FORMED GROUND PLATE RETAINED BY PLASTIC INSERT

This application claims benefit of U.S. Provisional Patent No. 60/238,027 filed Oct. 6, 2000.

BACKGROUND OF THE INVENTION

1. Field of the Invention

The present invention relates to electrical connectors, especially terminal blocks, with active electrical components between signal paths and ground.

2. Description of the Prior Art

Active, or non-resistive, capacitive elements can be incorporated into connectors to reduce cross-talk, improve impedance matching, filter out EMI/RFI (electromagnetic or radio-frequency interference), suppress transients (voltage "spikes"), and for various other purposes. Such elements are sometimes known as "chip capacitors" or simply "chips" and will be so referred here. The chips may be placed across two signal lines, from signal lines to ground, or otherwise as appropriate.

The chips may be held in a hole in the insulating housing of the connector, which provides both location and protection for the chip. This is illustrated by U.S. Pat. No. 6,036,545 to Caviness et al, entitled "Decoupled BNC Connector." It discloses a board mountable BNC electrical connector 10 with a spark gap feature that protects the connector against exposure to elevated voltages. The Caviness BNC connector is adapted to be mounted onto a printed circuit (PC) board to make grounding contact. The connector includes a grounding clip 76 which is mounted under the connector body or housing so as to be in contact with the PC board. As seen in FIG. 5, capacitors (chips) 68 are held in slots 66 to contact the conductive shell portion 18 on the inside and, on the outside, the upward-extending tines or arms 82 of the grounding clip 76. The grounding clip 76 is mounted to the PC board with board locks 84 that project downwardly from the base portion 80 of the clip 76. The board locks clip into holes in the board.

In the Caviness design only two chips can make contact with the shell portion 18.

A spark gap tab 74 projects up from the base 80 (in the opposite direction from the board locks 84). As best seen in FIG. 5, the tab 74 is fitted into a key way 72. This is the only apparent mechanical connection between the grounding clip 76 and the plastic housing, and it is not a strong connection. The narrow width of the tab 74, combined with the small overlap on the shoulder of the key way and the relatively weak nature of the insulating material, make for failure under any but the mildest stresses under pulling-out forces, and sliding of the tab in the key way could also be a problem.

In addition, the assembly of the tab 74 into the key way 72, followed by the bending of the conductor leads 54, is difficult to automate or perform rapidly.

Plass, in FIG. 1 of U.S. Pat. No. 5,242,318, shows an elongated plate 9 which Plass calls a filter carrier. It has a central opening, around which are contact tongues 9.1 that hold a thin planar filter 10. FIG. 1 of Plass, an exploded view with parts separated longitudinally, shows the filter 10 slid out transversely to the longitudinal direction, indicating that the tongues 9.1 provide a slot for the filter 10.

U.S. Pat. No. 4,500,159 to Briones et al. discloses a filter connector (24; 90; 116) with an electrically conductive shell (60; 91; 118) and a dielectric body (50; 93; 120) mounted to the shell and having a sidewall 52, a row of passages (56; 95; 123) extending through with each receiving an electrical contact (51; 97; 124), and a row of separated cavities (58; 99; 122) extending inwardly from the sidewall in a direction transverse to that of the passages with each communicating with only one respective passage. A monolithic chip-type capacitor chip 80, including active and ground electrodes, is disposed in each cavity. Their inner ends touch individual signal conductors, and their outer ends are pressed by resilient conductive spring tines 75 (see FIG. 3). The tines are bent over from fingers extending from the flat plate of a spring member 70. There are two members 70, one above and one below.

A resilient conductor (90) pressing against a chip (80) is disclosed in U.S. Pat. No. 5,340,334 to Nguyen, in FIG. 5.

U.S. Pat. No. 5,895,293, issued to Brandenberg et al, discloses a filtered terminal block assembly with a dielectric insert (20) having a cavity (48) including various-sized sub-cavities including a pocket (50) and a bore (52). The insert (20) is mounted in an opening (46) on a ground plate (16), and a ground member (22) extends from the plate to enclose the dielectric insert. The dielectric insert has a bore (52) and a cavity (48), in which a filter element (24, 26) is disposed. The filter element 24 is annular/cylindrical in shape, like a section of tubing; see FIG. 3. An electrical contact (14) extends through the filter element (24, 26). An outer end of the filter element (24, 26) is electrically connected to the electrical contact (14), and a ground member (22) is electrically connected between the filter element (24, 26) and the ground plate (16). An electrically-conductive thixotropic material (54) in a pocket (50) and along an inner surface of the cavity(48) electrically connects an inner end of the filter element (24, 26) to the electrical contact (14).

The Brandenberg connector cannot be adapted to multiple chips.

In U.S. Pat. No. 4,950,185, issued to Boutros et al, a planar filter array isolated from mechanical and thermal stresses by an arrangement of resilient planar gaskets which sandwich the array and by electrical contact springs which further isolate the array from mechanical and thermal stresses while permitting electrical connection to the individual filters.

U.S. Pat. No. 5,397,250 discloses a modular jack connector arranged to optionally accommodate both a ferrite block inductor arrangement and chip capacitors. The connector can be assembled and all components secured in place in four insertion steps, without soldering or other bonding techniques.

The prior art does not disclose a structure allowing more than one or two chips to be coupled between a conductor, such as a signal lead, and a ground plane. Neither does it disclose a secure arrangement of a ground plane for a terminal block, or any means for retaining a grounding sheet.

OBJECTS AND SUMMARY OF THE INVENTION

It is an objective of the capacitor chip filtered terminal block of the invention to provide an assembly capable of filtering EMI/RFI and/or transients from the circuit into which it is installed, by providing flexibility of accepting zero to four chips, or more, per contact location.

Another object of the invention is an assembly with a reduced number of assembly operations, and particularly no soldering operations during top-level assembly (except for some termination attachments) and thereby lower cost.

It is another objective of the present invention to provide a protective barrier for the chip within an insulating housing, and a stable protective location for the chip with stress isolation from the external loads applied to the ends of the contacts. Such forces include screw-tightening torque and forces applied to the contact to make external electrical and mechanical connections, and thermal stresses as well.

Still another object of the invention is to provide the capability of having a plurality of different circuits within one terminal block, including filter and non-filtered circuit types, including grounded terminations.

Another object of the invention is to provide a solution of a press fit contact for a terminal block by using a coil spring installed inside the tines, in order to have better control of insertion, removal and retention forces from PCB, and a higher current carrying capability.

With these and other objects, advantages and features of the invention that may become hereinafter apparent, the nature of the invention may be more clearly understood by reference to the following detailed description of the invention, the appended claims and to the several drawings attached herein.

The first two preferred embodiments of the present invention are a terminal block with a formed conductive sheet metal as the grounding component. The terminal block is comprised of a plastic housing that has a plurality of contacts. The housing and the contacts may be arranged in a variety of configurations. The contacts are retained in the housing by interference fit, mold-in-place, or captivation, or any other suitable retention means. The terminations of the contacts are in the form of any combination of pin, socket, mounting lugs, quick disconnect contacts, compliant pins, press fit terminals, cables, wires, threaded posts which may have the associated hardware, wire wrap, and solder cups.

The electrical component is held in a cavity in the housing. The cavity for the electrical component is located adjacent to the contact in the housing. The electrical component is retained in the housing by the grounding component, and a retention insert.

The electrical component makes electrical connection to the contact by the application of a compressive load. This load is applied to the electrical component by the grounding component. The grounding component is comprised of a formed conductive sheet formed into a spring configuration. The grounding component makes electrical connection to the electrical component, and to the panel or PC board into which the filtered terminal block is installed. It is retained in the connector by the retention insert. The retention insert resists the load applied to the chip from the formed tine on the grounding component. The retention insert is retained in the terminal block by an interference fit with the contacts, or other suitable means.

In a third embodiment, the terminal block has a flat plate as the primary grounding component. The terminal block is comprised of a plastic housing that has a plurality of contacts. The housing and the contacts may be arranged in a variety of configurations. The contacts are retained in the housing by interference fit, mold-in-place, or captivation, or any other suitable retention means. The terminations of the contacts are in the form of any combination of pin, socket, mounting lugs, quick disconnect contacts, compliant pins, press fit terminals, cables, wires, threaded posts which may have the associated hardware, wire wrap and solder cups.

The electrical component is held in a cavity in the housing or in the grounding component or both. The cavity for the electrical component is located adjacent to the contact in the housing. The electrical component is retained in the housing by the primary grounding component, and the secondary grounding component.

The electrical component makes electrical connection to the contact by the application of a compressive load. This load is applied to the electrical component by the grounding components. The grounding component may be comprised of any combination of a formed conductive sheet, machined plate, conductive elastomer, or conductive spring. The grounding components make electrical connection to the electrical component, and to the panel into which the filtered terminal block is installed.

DETAILED DESCRIPTION OF THE INVENTION

Here, and in the following claims, "chip" includes any discrete electrical element or combination of elements, whether resistive, inductive, capacitive, or active, and for example includes transient suppression diodes, capacitors, metal oxide varisters, grounding chips, feed through contacts (no electrical component), spark gap devices, and similar devices, and so on.

A first embodiment, a terminal block, is shown in FIGS. 1*a*–3.

Figure 1A:
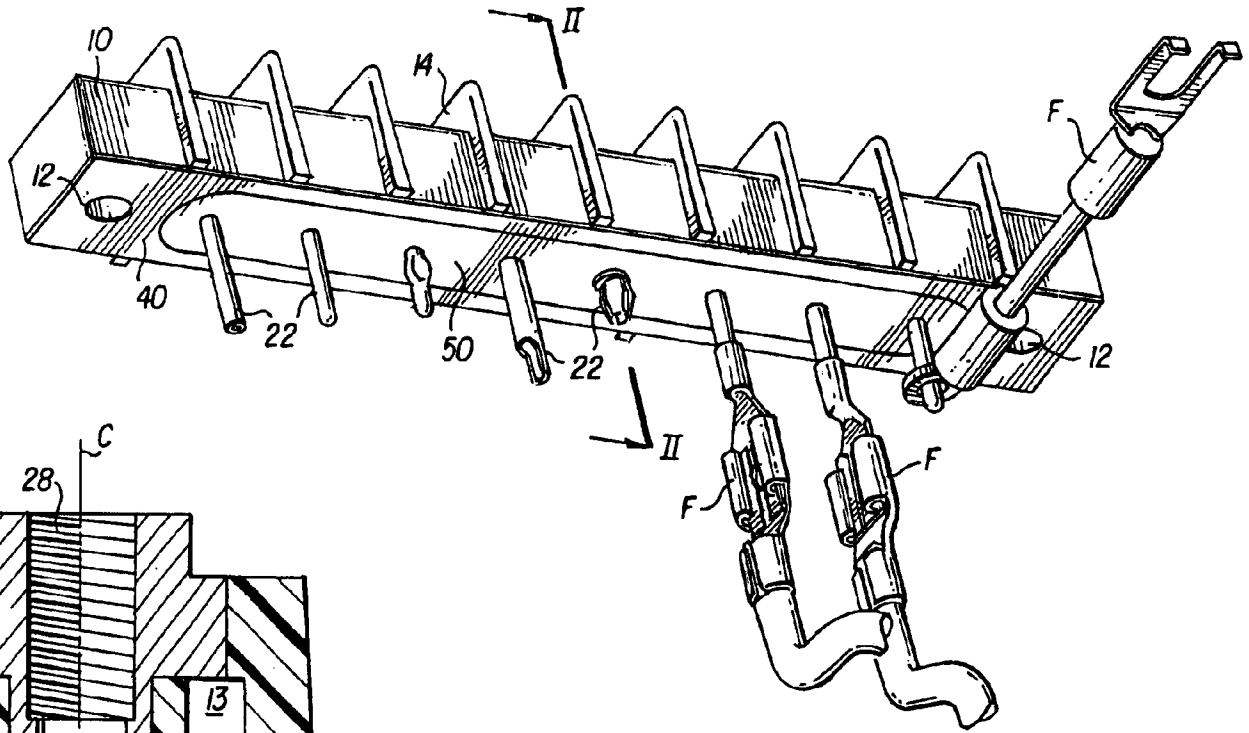
FIG. 1*a* is a perspective view of a first embodiment of the invention.
Figure 2:
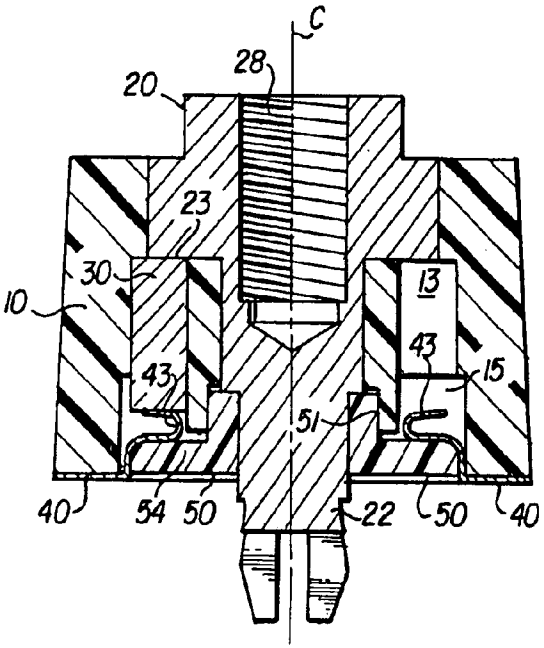
FIG. 2 is a cross-sectional view of the embodiment FIG. 1*a* taken on section II—II.

FIGS. 1*a*–2 illustrate a first preferred embodiment of the present invention, a terminal block with an insulating (for example, plastic) housing 10 and contacts 20 that may be arranged in a variety of configurations. In the illustrated embodiment the contacts 20 are arrayed in linear single file. In FIG. 1 the terminations or lower connections 22 of the contacts 20 are visible protruding from the bottom of the terminal block housing 10. (Various different types of contact with different lower end connections 22 are shown mounted in the a single housing 10, to illustrate the different types.) Various fittings F are seen attached to the lower connections 22.

Figure 1B:
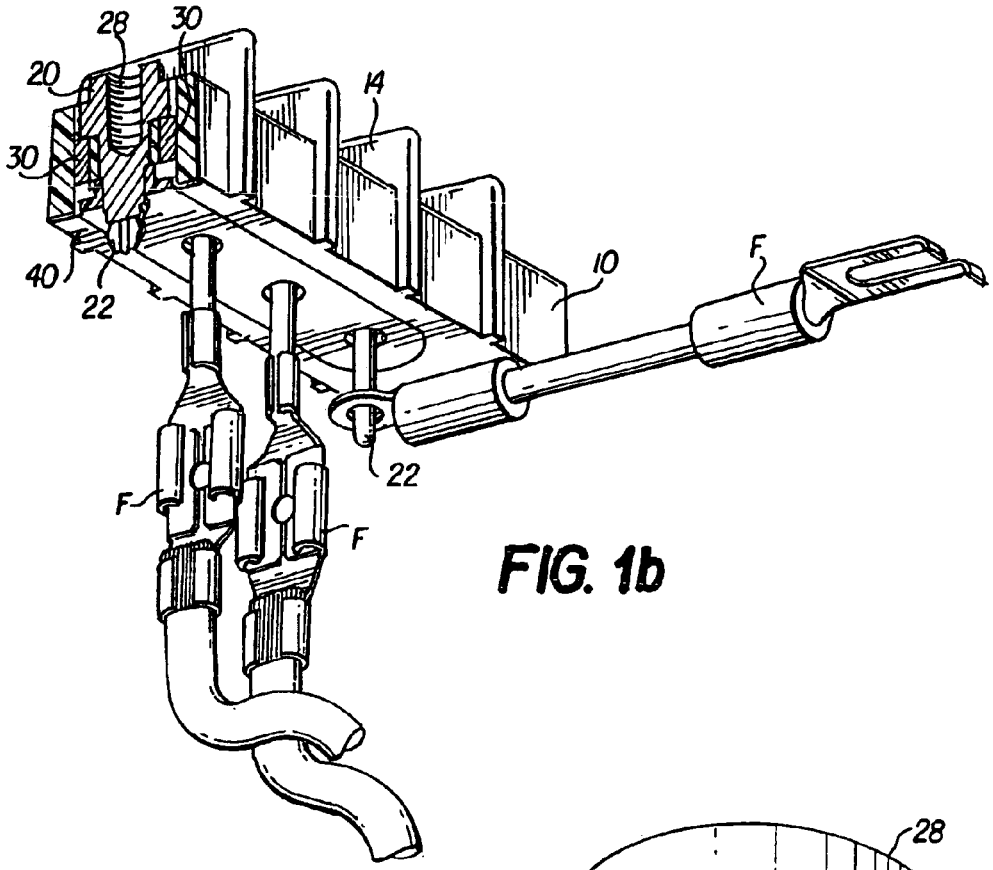
FIG. 1*b* is a perspective cut-away view of the embodiment FIG. 1*a*, with a cut indicated by arrows II—II.
Figure 1C:
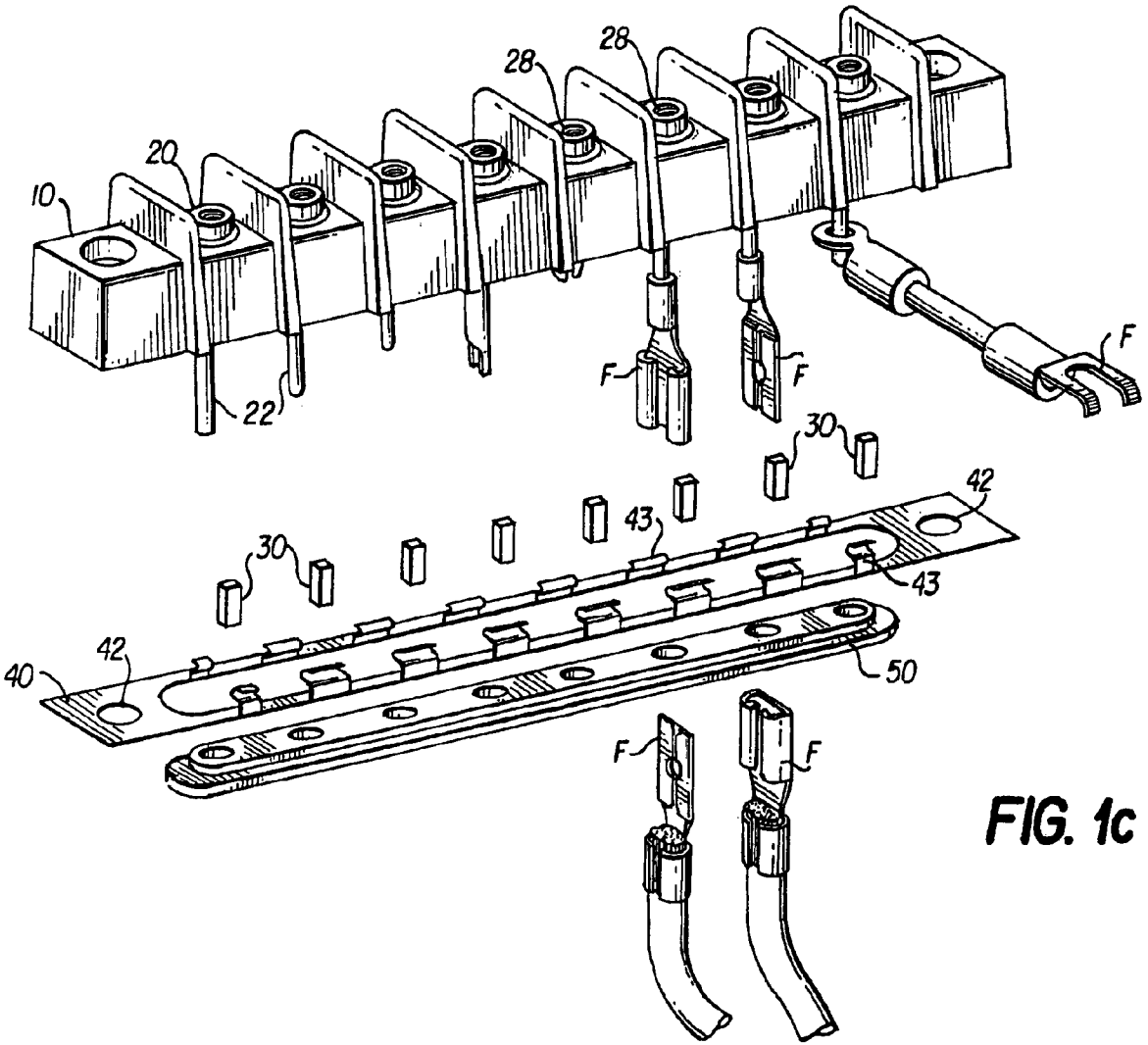
FIG. 1*c* is an exploded perspective view of the embodiment FIG 1*a*.

In FIG. 1*c* the upper connections 28 are visible. The illustrated connections are tapped holes, but any type can be provided. The contact termination ends (upper 28 or lower 22) may be in the form of pin, socket, mounting lugs, solder cup, quick disconnect, compliant pins, press fit terminals, cable, wire, threaded posts (which may have the associated hardware), or any other configuration suitable for making electrical connection.

The housing 10 has attachment holes 12 at both ends thereof, and preferably has ribs 14 between adjacent terminal contacts.

On the bottom side of the terminal block 10, which is visible in FIG. 1, a retention insert 50 and grounding component or ground plate 40 are visible. These are more clearly seen in the exploded view of FIG. 1*c*, in which a number of chips 30 are visible above the ground plate 40. The chips are located in pockets or cavities 13 in the bottom side of the housing 10. They make electrical connection to the underside of the upper portion of the contact 20, as explained below.

The contacts are preferably retained in the housing by a barb (interference fit), molding in place, clamping, or any other suitable retention means. The surface 21 is preferably knurled. A flat 27, visible in FIG. 3, may be provided to resist turning.

FIG. 2 shows a variation of the first embodiment, in which there are possibly more than four chips 30 to each contact 20. FIG. 2 is a cross section taken on two angled planes that meet at the center line C, the axis of the contact 20.

The chip 30 is held and makes electrical connection to the contact 20 by a compressive force created by a spring tine 43 of the conductive grounding component 40, which is made from conductive sheet with finger portions formed into spring tines 43, as seen in FIG. 1*c*. The tines 43 are captivated between the retention insert 50 and the chip 30. This provides protection from external mechanical forces that could damage the spring tine 43 and the chip 30. FIG. 2 illustrates, on the right side, an empty cavity 13 in which there is no chip 30.

Figure 3:
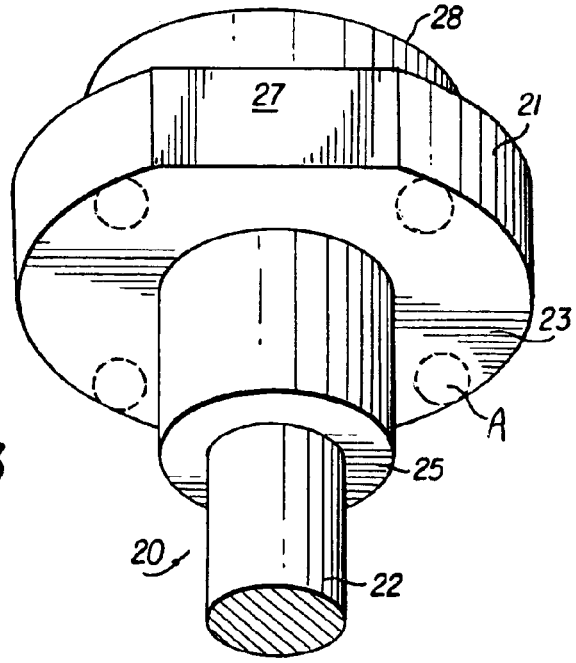
FIG. 3 is a perspective view of a contact of the embodiment of FIG. 1.

FIG. 3 shows the contact 20 of FIG. 2 from underneath, similar to the view of FIG. 1*b*. A chip-contacting surface 23, formed by a shoulder at the bottom of an annular flange 21, has four chip-contacting areas A that are indicated in FIG. 3 by dashed lines. (One of those chip-contacting areas is also visible in FIG. 2, as the line at the top of the chip 30.) It will be understood that each of the areas A corresponds to one cavity 13 in the housing 10 above the annular flange 21, and that four various different chips 30 can be put between the contact and the grounding plate, all in parallel. The present invention also contemplates that two chips may be placed into one cavity, either stacked so as to be in series or placed side-by-side. In the latter case the number of chips and cavities may not match.

The invention also includes a connector with exactly two chip cavities 13 per contact, for example, one on either side of the longitudinal axis of the contact.

While the chip-contacting shoulder is exemplified by the illustrated flat surface 23, the chip-contacting shoulder is not limited to a flat surface. The shoulder surface may be stepped (for different lengths of chip, for example), may be conical, may include surface features or attachments to improve electrical contact, and so on. The present invention is limited to no particular shape, surface, outline, or size of the shoulder.

The invention is not limited to a particular quantity of contacts or chips. A different quantity of contacts or chips (not shown) may be desirable in some applications. The housing and the contacts may be arranged in a variety of configurations. The contact termination ends may be in the form of pin, socket, mounting lugs, solder cup, quick disconnect, compliant pins, press fit terminals, cable, wire, threaded posts which may have the associated hardware or any other configuration suitable for making electrical connection.

In the illustrated preferred embodiment the chips 30 are pressed against the areas A by the chip tines 43 and electrical connection to ground is through the ground plate 40 which, as shown in FIGS. 1*c* and 2, includes a generally flat outer portion adapted to be pressed against a ground surface such as a metalized grounding area of a PC board, or some grounded conductive component, when the housing 10 is mounted on that conductive ground surface. Screws (not shown) installed through the holes 12 and 42 into the grounding surface and tightened would provide a good ground connection to each of the chips 30 in the assembly.

The chips 30 can also or alternatively be located at the sides, bottom, top or any location around the contact 20 and partially or fully inside the housing, within the scope of the invention. For example, chips can be also pressed against the sides of the contact 20 in the manner of the Caviness et al. '545 patent discussed above (not shown in the drawing). In combination with the areas A shown in FIG. 3, even more chips could be placed into contact with each contact 20 by urging them against the sides of the annular flange 21 or the sides of the other lower annular steps. The grounding plate, in such an embodiment, would preferably include additional tines (not shown) along the side of the housing 10, similar to the tines 76 shown by Caviness et al.; or, a single solid sheet of the same cross-sectional shape could be used.

FIG. 2 shows that, on the bottom of the housing 10, the lower connections 22 are spaced well away from the outer portion or periphery of the ground plate 40 and there is little chance of grounding the contact lower connection end 22. Internally, there is also no chance of accidental grounding because the chip tine 43 is separated from the contact 20 by insulating material, of the housing 10 and the retention insert 50. Both are preferably molded of plastic.

The retention insert 50 is, preferably, press-fitted into a mating opening 15 in the bottom of the housing 10. That mating opening 15 merges with the chip cavities 13 so that the chips can be dropped into place when the housing 10 is upside-down, preferably after the contacts 20 are fastened in place. The grounding plate 40 can make an interference fit with the portion of the chip tines 43 which are adjacent the flat periphery and vertical in FIG. 2, which in turn can interfere with the opening 15 of the housing 10; and the protruding upper part 51 of the retention insert 50 can make an interference fit with the mating portion of the opening 15. The retention insert 50 may of course also or alternatively be held in place by other means. The bottom of the retention insert 50 is preferably flat and just above flush with the bottom of the housing 10. A platform portion 54 of the retention insert 50 supports the chip tine 43 and resists the force exerted downward by that spring element.

While a stamped spring-metal sheet with bent tines 43 is preferred, the ground plate 40 may include any combination of a machined plate, a stamped and formed sheet metal plate, a conductive rubber component, or a separate conductive spring. The ground plate may be retained to the housing by bonding, riveting, clamping, threaded fasteners, or any other suitable means.

Figure 4:
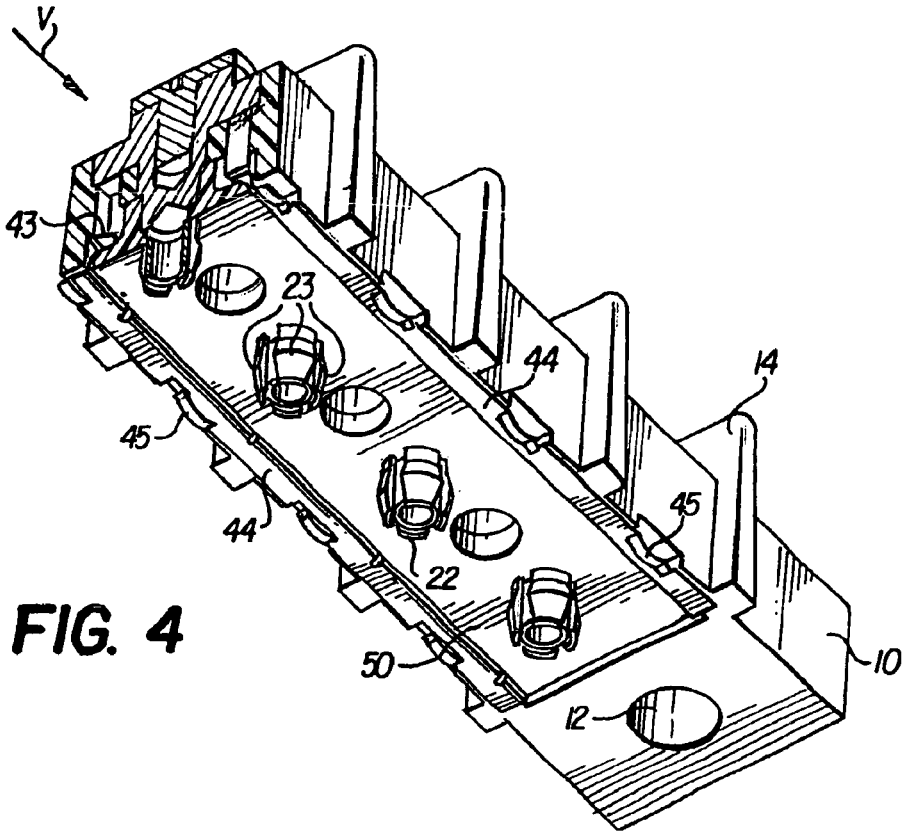
FIG. 4 is a perspective partial view of a second embodiment of the invention.
Figure 5:
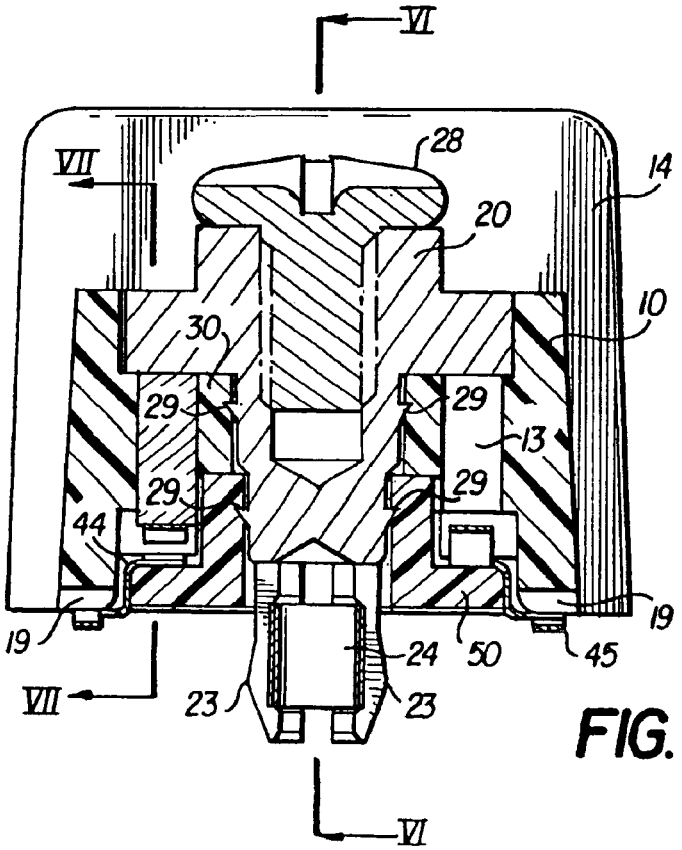
FIG. 5 is a view, resembling a cross-sectional view, in the direction of arrow V of FIG. 4.

FIGS. 4–10 show a second, most preferred embodiment of the present invention. FIG. 4 shows part of a complete connector, with the left portion removed. The arrow V indicates the direction of a second view of this embodiment, which is FIG. 5. This embodiment differs in several ways from that of FIGS. 1–3.

Figure 9:
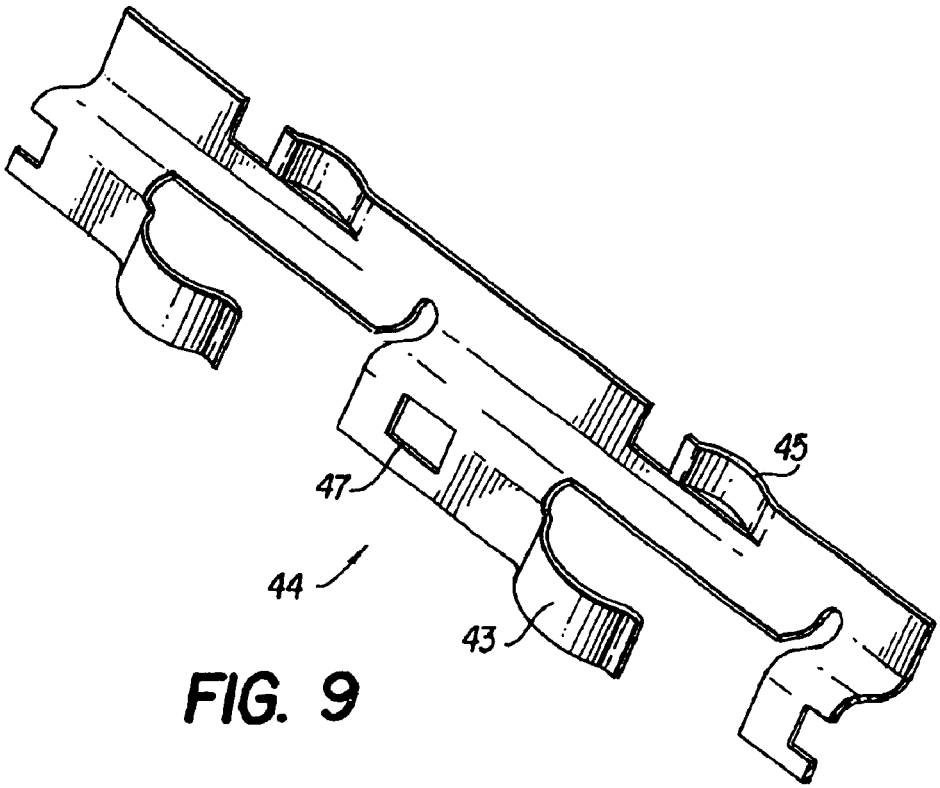
FIG. 9 is a perspective view of a ground strip.

One difference is that the ground plate is embodied as two distinct, separate, parallel ground strips 44 (one of which is shown alone in FIG. 9). Preferably, the ground strips 44 are identical on the left and right sides of the housing 10. This permits continuous fabrication of ground strip material, that can be cut to length for any length of housing 10 and installed on both sides. It also adds the flexibility of providing a ground strip 44 on only one side of the housing 10, if one will suffice.

As with the ground plate 40 of the first embodiment, the ground strips 44 may include any combination of a machined plate, a stamped and formed sheet metal plate, a conductive rubber component, or a separate conductive spring, and may be retained to the housing by bonding, riveting, clamping, threaded fasteners, or any other suitable means.

Figure 7:
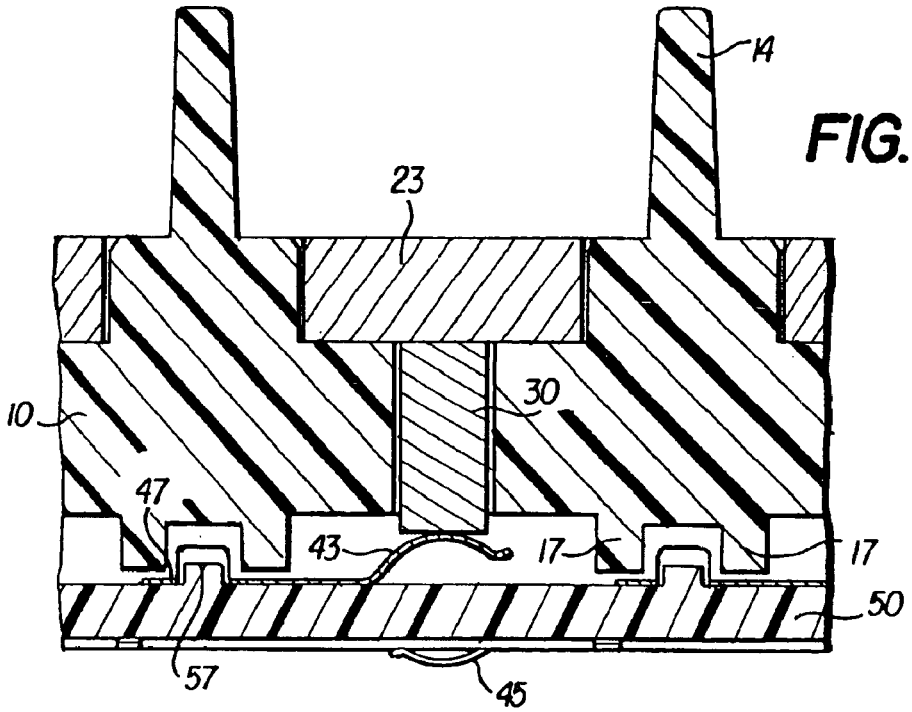
FIG. 7 is a cross-sectional view taken on section line VII—VII of FIG. 5.

To locate the ground strip 44 accurately, alignment holes 47 on the ground strip preferably fit onto alignment bosses 57 on the retention insert 50. The alignment bosses 57 are seen in FIGS. 7 and 8.

To locate the assembled ground strips 44 and retention insert 50 onto the housing 10, U-shaped stabilizing bosses 17, that straddle the alignment bosses 57, are preferably provided on the bottom of the housing 10. These bosses 17 also reduce tilting of the ground strips and stabilize them. They are seen in perspective in FIG. 10 and in cross section in FIG. 7.

Figure 6:
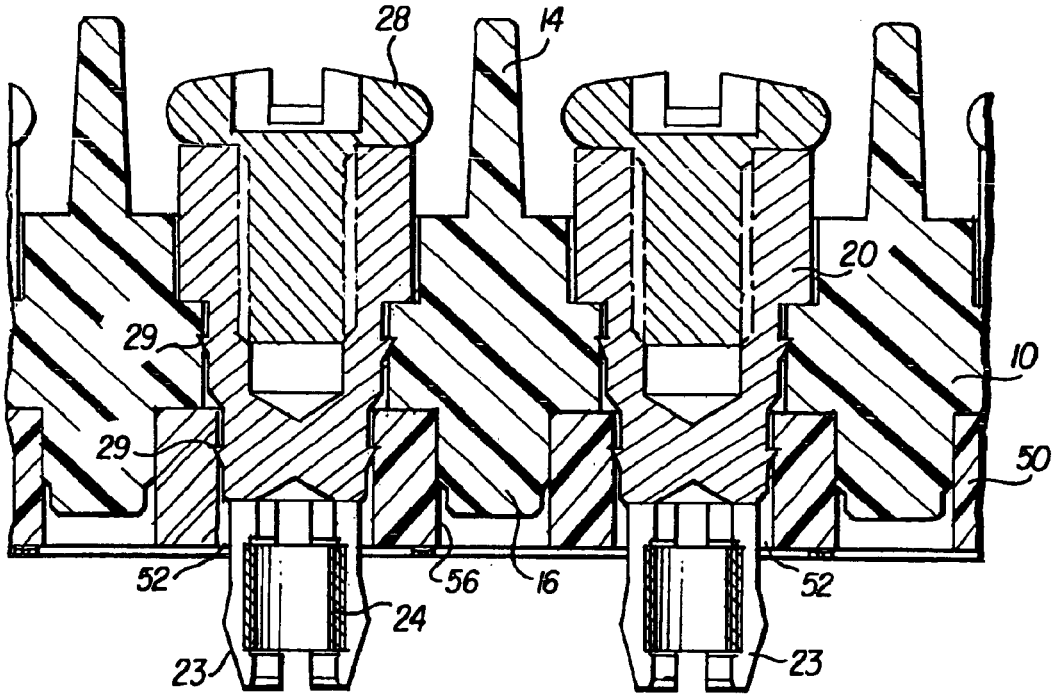
FIG. 6 is a cross-sectional view taken on section line VI—VI of FIG. 5.
Figure 8:
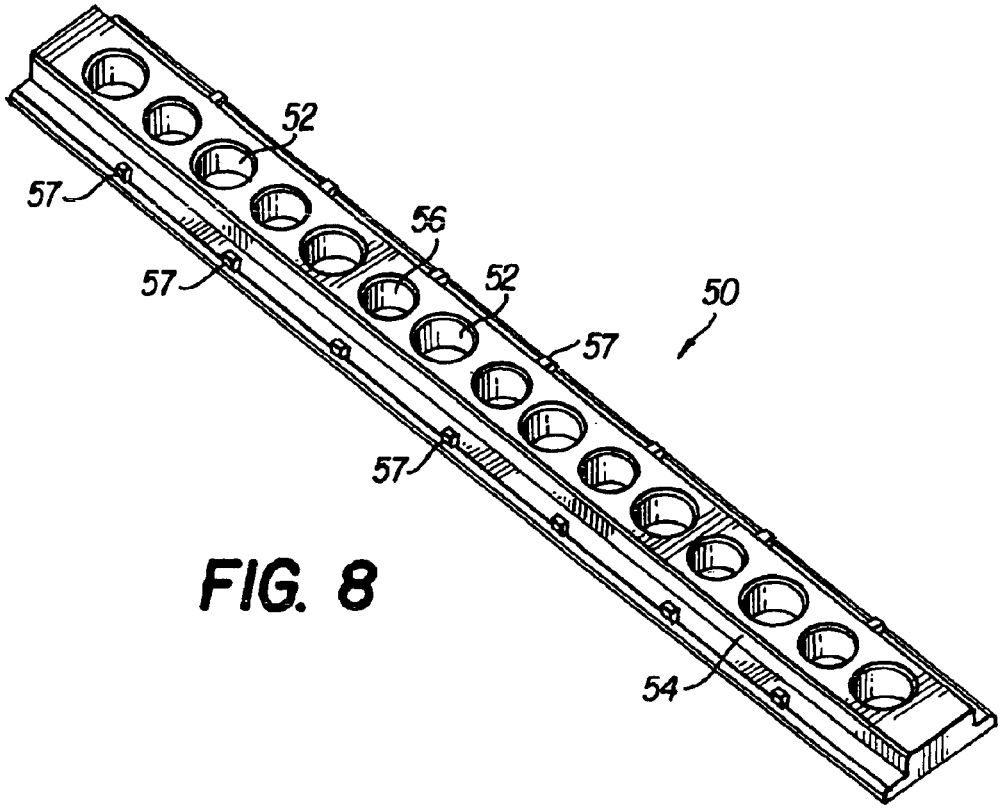
FIG. 8 is a perspective view of a retention insert.
Figure 10:
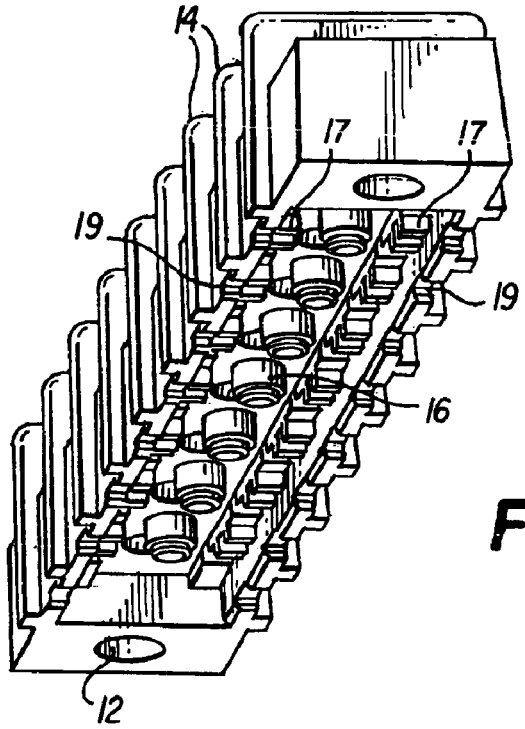
FIG. 10 is a perspective view of a bare housing.

The entire assembly is still more firmly fixed by bosses 16 on the housing 10, that mate with openings 56 in the retention insert 50 (FIGS. 8 and 6; the bosses 16 are also shown in FIG. 10). Other round openings 52 are sized to accept the contact lower connection ends 22 of the contacts 20 (FIGS. 8 and 6). The bosses 16 are preferably knurled.

Like the grounding plate 40 of the first embodiment, the ground strip 44 of the second embodiment has chip tines 43 that press upward against the chips 30, but it also has grounding tines or fingers 45 that press in the opposite direction against a PC board or conductive panel (not shown). Because of the resilience of the conductive, springy grounding fingers 45, the ground strip 44 can still make contact with an underlying surface even when it is not clamped against that surface (it need only be held such that the grounding fingers 45 are deflected enough to give sufficient ground connection. As a result, the housing 10 end portions that contain the bolt end mounting holes 12 may be omitted, because the hold-down force of bolts or screws is no longer needed. The housing 10 preferably includes recesses 19 on the bottom surface above each grounding finger 45 to permit a portion of the finger 45 to deflect upward when the PCB surface presses it in that direction.

Bolts, screws, rivets and the like may, in the second embodiment, be eliminated and the holding force is then preferably supplied by the contact lower connection ends 22, which in the embodiment of FIG. 4 are press-fit contacts. Each press-fit connection end 22 comprises a number of contact tines 23 (for example, the four illustrated), that are resilient in the radial direction and have outer bulges that together comprise a flange-like region of increased diameter that is slightly greater than the diameter of the PCB hole (not shown) into which the contact tines 23 are intended to go. The entire terminal block can thus "press" onto the PCB with grounding connection to the PCB assured by the forces applied to the PCB by the deflection of the grounding fingers 45 . The bulge 23 on the contact passes into the PCB board hole, and makes contact to the inside diameter of the PCB hole, and can hold the terminal block to the PCB, and maintains the deflection of the grounding fingers 45.

The distance of the flange-like region of increased diameter from the bottom surface of the connector may be adjusted to the thickness of the PCB for which the connector is intended. The radial force should be adjusted to permit repeated installation and removal of the connector without damage to the PCB.

Because the bolt holes 12 are no longer needed (though they may be retained, as illustrated), the housing 10 can be cut to length from a continuous long blank, like the grounding strip 44. If connectors with different numbers of contacts are to be made, it is then possible to do so with only one mold, by cutting long housings into sections as desired. (The bolt hole 42 in the first-embodiment grounding plate 40 is, of course, not present in the embodiment of FIG. 4.) Press-in assembly to the PCB eliminates the need for soldering as well as the need for assembly hardware.

Preferably a spring 24, generally tubular in the shape and in the form of a single or double rolled spring, it is fitted inside the contact tines 23, to increase the radial force as the press-fit connection end 22 passes into the PCB, and applies this radial force to the hole to create electrical connection, and provide a mechanical retention force. The presence of spring 24 increases the radial forces of the contact tine to the PCB hole, contact retention and current carrying capacity which allows for repeated installation and removal of the terminal block and connectors of other styles that use the press-fit contact. This can eliminate the need for hold-down hardware in some applications..

The contacts 20 preferably include directed barbs 29 that hold the contacts 20, once inserted, into the housing 10 and the openings 52 of the retention insert.

The termination of the contacts may be in the form of any combination of pin, socket, mounting lugs, quick disconnect contacts, compliant pins, press fit contacts, cables, wires, threaded posts (which may have the associated hardware), wire wrap and solder cups. In some combinations the bolt holes 12 may be required to ensure deflection of the grounding tines 45 and resulting ground connection.

Figure 12:
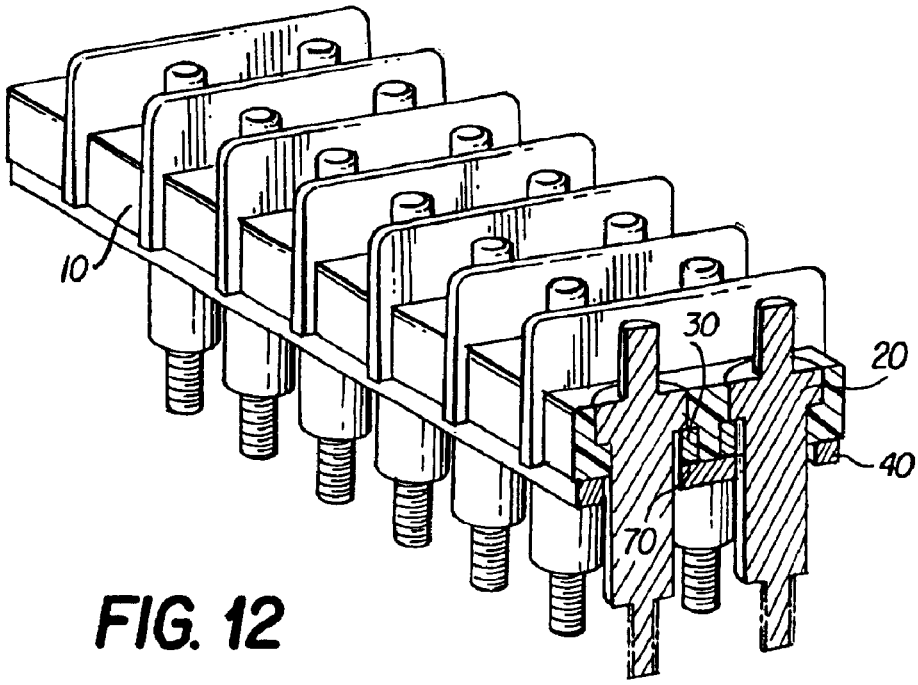
FIG. 12 is a view similar to that of FIG. 1*b*, of the third embodiment of the invention.
Figure 11:
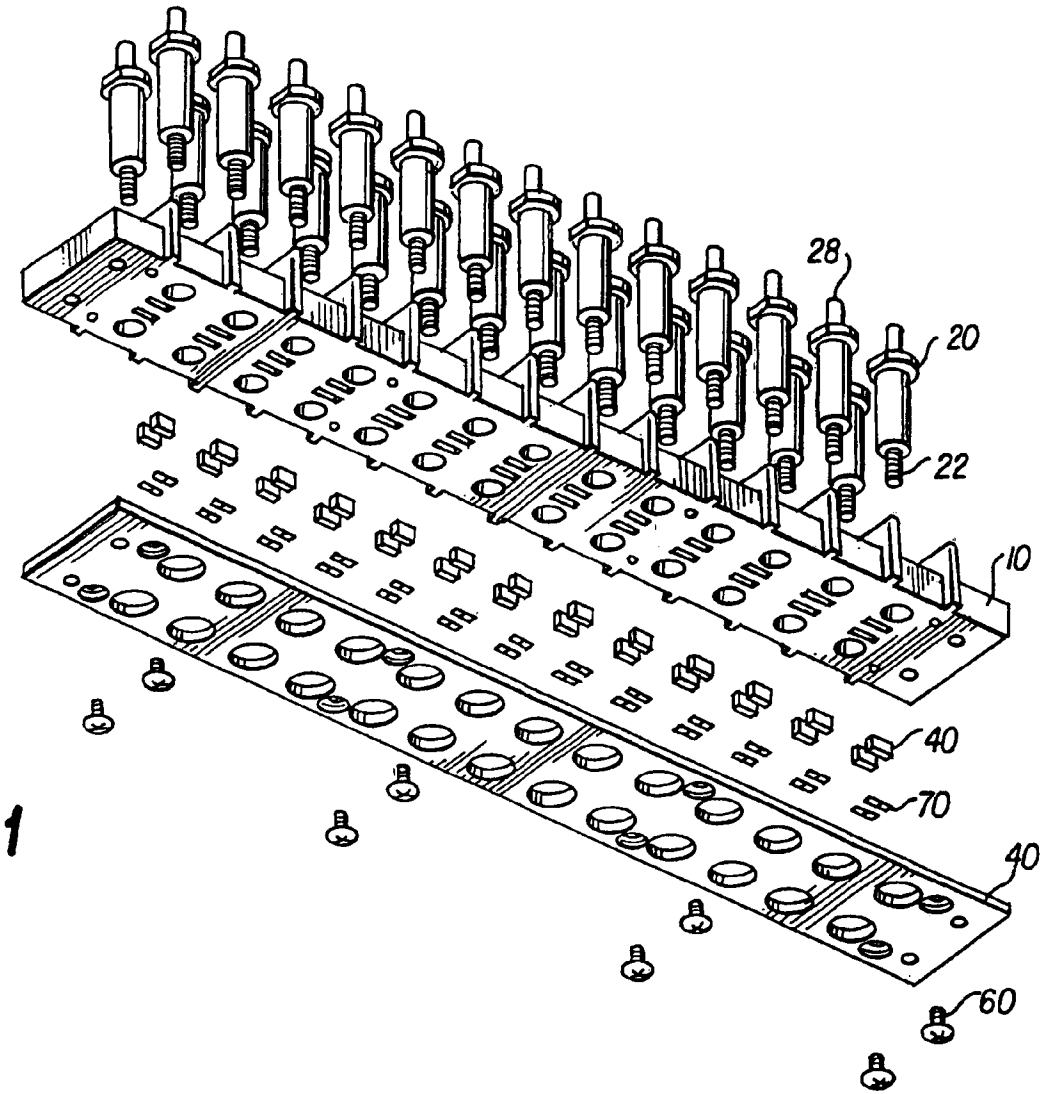
FIG. 11 is a view similar to that of FIG. 1*c*, of a third embodiment of the invention.

FIGS. 11 and 12 show an alternative third embodiment with a machined ground plate 40 that is fastened with screws 60 rather than being pressed onto the housing 10, and separate springs to compress the chips 30. This embodiment has two rows of contacts 20 and, in place of the tines 43 of the first embodiment it employs individual resilient conductor springs 70, or a conductive strip. These are preferably pieces of conductive elastomer, but may include coil springs or other resilient conducting devices. The grounding component in this embodiment comprises the flat plate 40 as a primary grounding component and the resilient conductors 70 as secondary grounding components.

The contacts 20 in the embodiment of FIG. 11 have, like the contacts 20 of the first embodiment, an annular flange 21 which again permits four or more chips to be placed in parallel between each contact 20 and electrical ground. Although only one chip 30 per contact 20 is illustrated for the sake of clarity, the cavity/chip/resilient conductor combination can clearly be multiplied by a person skilled in the art, to provide plural chips as desired.

In summary, the present invention has a number of advantages.

One major advantage is that up to four or more chips per contact can be provided, and chips of different types can be combined, on one contact or signal carrier. Different types can be combined: feed through, ground, capacitive, transient suppression, spark gap, and so on.

A wider range of capacitance is available, by using plural chips, and increased dielectric breakdown voltage and current-carrying capabilities are also made possible by the present invention. The chips may be assembled in a parallel to significantly increase the capacitance; the chips may be assembled in a series circuit (e.g., several chips in one chip cavity 13) to significantly increase the voltage tolerance. Also, the capacitance value achieved using chip capacitors greatly exceeds that of tubular capacitors of the same voltage rating.

The formed conductive sheet metal grounding components or component reduces the size of the filtered connector so that the overall package size is essentially that of an unfiltered terminal block.

The retention insert protects the formed tines from the external environment.

Assembly with conductive grounding components that are formed from conductive sheet, conductive rubber, or a conductive spring, as opposed to relying on a soldered ground component, is an advantage. The stress isolation of the filter component prevents damage and subsequent failure due to stresses induced during assembly of the terminal into the next application.

Press or snap-in assembly optionally without bolts, screws, rivets saves assembly time and parts cost.

Lower cost is associated with rapid assembly.

While the embodiments described above are terminal blocks, the present invention is not limited to terminal blocks, but includes any type of connector within the scope of the following claims. For example, the annular flange with plural chip-contact areas of the invention could be adapted to a cable-type connector like that illustrated in the Nguyen '334 patent discussed above. The "lower" contact end might not be underneath, in that case, and the press fit contact end with possible tubular shaped rolled spring could also be incorporated in other styles of connection devices.

Although certain presently preferred embodiments of the present invention have been specifically described herein, it will be apparent to those skilled in the art to which the invention pertains that variations and modifications of the various embodiments shown and described herein may be made without departing from the spirit and scope of the invention. Accordingly, it is intended that the invention be limited only to the extent required by the appended claims and the applicable rules of law.

What is claimed is:

1. A connector adapted for housing an electrical element and adapted to be mounted on a surface, the connector comprising:

an insulating housing including a plurality of electrical element-accepting cavities, each cavity having a first end and a second end;

at least one conductive terminal contact mounted in the housing, the contact including a lower connection accessible on a grounding side of the housing and an upper connection accessible on a side of the housing opposite to the grounding side, and wherein the contact includes a shoulder shaped as an annular flange having a flat electrical-contacting area capable of contacting a plurality of electrical elements disposed at the second end of each of the electrical element accepting cavities;

a ground plate on the grounding side; and a plurality of spring means for engaging in electrical contact with the ground plate, the spring means being emplaceable at the first end of each of the electrical element-accepting cavities, wherein the plurality of spring means is a plurality of conductive springs; and whereby electrical elements are resiliently holdable between the shoulder and the conductive springs, to form an electrical path through the shoulder, the element, the conductive springs, and the ground plate.

2. The connector of claim 1, wherein the springs comprise respective resilient tine portions of the ground plate that make direct connection to ground.

3. The connector of claim 2, wherein the ground plate comprises a central opening surrounding the lower connection of the contact, and the tines project from an inner periphery of the ground plate.

4. The connector of claim 2, wherein the ground plate comprises at least one ground strip disposed generally parallel and exposed to the grounding side for making direct electrical grounding connection for electrical elements to a printed circuit board and conductive panel.

5. The connector of claim 1, wherein the ground plate comprises resilient grounding finger portions that extend from the grounding side.

6. The connector of claim 1, comprising a retention insert holding at least a portion of the ground plate to the housing.

7. The connector of claim 6, wherein the retention insert comprises a platform supporting the springs that compress the electrical elements.

8. The connector of claim 6, wherein the springs comprise respective resilient tine portions of the ground plate and wherein the platform supports the tines.

9. The connector of claim 6, wherein the platform is fitted together with the ground plate and the housing.

10. The connector of claim 1, wherein the lower connection is a press-fit contact.

11. The connector of claim 1, wherein:

the electrical element is a chip;

the electrical element-accepting cavities are chip-accepting cavities;

the plurality of spring means is a plurality of conductive springs;

and the connector further comprises a retention insert holding at least a portion of the ground plate to the housing.

12. The connector of claim 11, wherein the retention insert comprises a platform supporting the springs that compress the chips.

13. The connector of claim 11, wherein the springs comprise respective resilient chip tine portions of the ground plate and wherein the platform supports the tines.

14. The connector of claim 11, wherein the platform is fitted together with the ground plate and the housing.

15. The connector of claim 11, wherein the ground plate comprises resilient grounding finger portions that extend from the grounding side, and that are repeatedly installed and removed from its installation while maintaining sufficient contact force.

16. The connector of claim 11, wherein the ground plate comprises one or more ground strips and the ground strips can be cut to different sizes from a continuous reel.

17. The connector of claim 16, wherein the two ground strips are identical on a left and a right side of the insulating housing.

18. The connector of claim 16, wherein the ground strips include alignment holes that fit into alignment bosses on the retention insert.

19. The connector of claim 16, wherein the grounding strips include chip tines that press upward against the chips.

20. The connector of claim 16, further comprising grounding fingers that press against a PCB or conductive panel.

21. The connector of claim 20, wherein the insulating housing includes recesses on the bottom surface of the insulating housing above the grounding fingers.

22. The connector of claim 11, wherein the lower connection is a press-fit contact.

23. The connector of claim 22, wherein the press-fit contact comprises a plurality of tines.

24. The connector of claim 11, wherein a lower connection includes a press fit contact that is comprised of a plurality of tines, wherein a spring is fitted inside the tines to increase a radial force as the press-fit contact passes into and remains in said surface providing a low electrical resistance connection.

25. The connector of claim 18, wherein the insulating housing has a plurality of U-shaped bosses to stabilize and reduce the tilting of the independent ground strips.

26. The connector of claim 11, wherein press fit contacts have a single or double rolled spring to increase the radial forces of the contact tine to a PCB hole, contact retention and electrical current carrying capacity, which allows for repeated installation and removal of a terminal block and connectors of other styles that use the press fit contact, wherein the rolled spring allows the press fit contacts to be manufactured from a machined material.

27. The connector of claim 26, wherein the connector may be installed in a printed circuit board and a conductive panel without any additional hardware.

* * * * *